US005944005A

United States Patent [19]

Schiff

[11] Patent Number: 5,944,005

[45] Date of Patent: Aug. 31, 1999

[54] RETRACTING ARROW REST

[76] Inventor: Charles M. Schiff, 117 N. Floral Leaf Cir., The Woodlands, Tex. 77380

[21] Appl. No.: 08/895,554

[22] Filed: Jul. 16, 1997

[51] Int. Cl.[6] ..... F41B 5/22

[52] U.S. Cl. ..... 124/44.5

[58] Field of Search ..... 124/24.1, 44.5

[56] References Cited

U.S. PATENT DOCUMENTS

| | | | |
|---|---|---|---|
| 2,975,780 | 3/1961 | Fisher | 124/24.1 |
| 3,504,659 | 4/1970 | Babington | 124/24.1 |
| 4,287,868 | 9/1981 | Schiff | 124/44.5 |
| 4,453,528 | 6/1984 | Eckert | 124/44.5 |
| 4,676,220 | 6/1987 | Pietraszek | 124/44.5 |
| 4,685,439 | 8/1987 | Cosentino | 124/44.5 |
| 4,803,971 | 2/1989 | Fletcher | 124/44.5 |
| 5,365,912 | 11/1994 | Pittman | 124/44.5 |
| 5,490,492 | 2/1996 | Savage | 124/44.5 |
| 5,503,136 | 4/1996 | Tone | 124/44.5 |
| 5,632,263 | 5/1997 | Sartain | 124/44.5 |

*Primary Examiner*—John A. Ricci
*Attorney, Agent, or Firm*—Mary J. Gaskin

[57] ABSTRACT

An arrow rest assembly attached to a bow is designed to be horizontally movable in order to clear the fletching on a released arrow. The arrow rest assembly incorporates a flexible positioner to position the arrow away from the handle of the bow, in line with the bow string and in clearance of the fletching. An arrow rest holds the arrow in position while the bow is drawn and the arrow is aimed. The arrow rest assembly has a triggering control which responds to the movement of the bow string after the arrow is released; such triggering control retracts the arrow rest from its extended holding position to its retracted clearing position before the fletching of the arrow passes by the arrow rest. The triggering control can be adjusted relative to the bow string in order to vary the timing of the arrow rest's retraction.

5 Claims, 2 Drawing Sheets

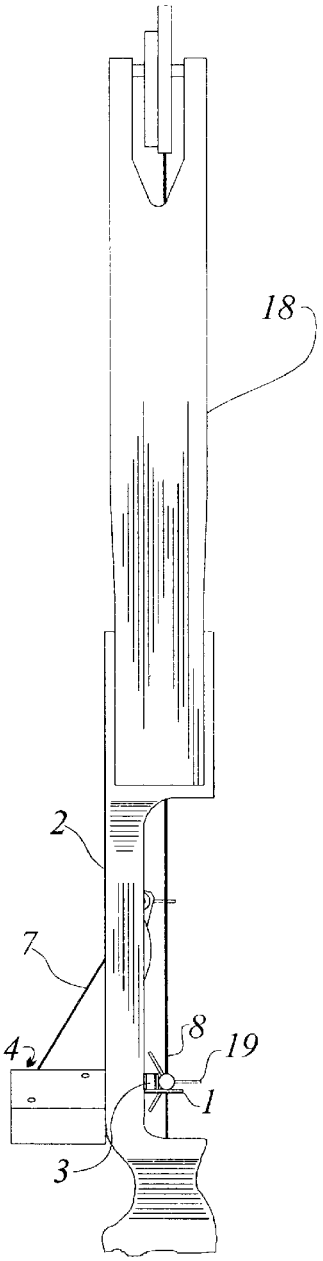
FIG. 1
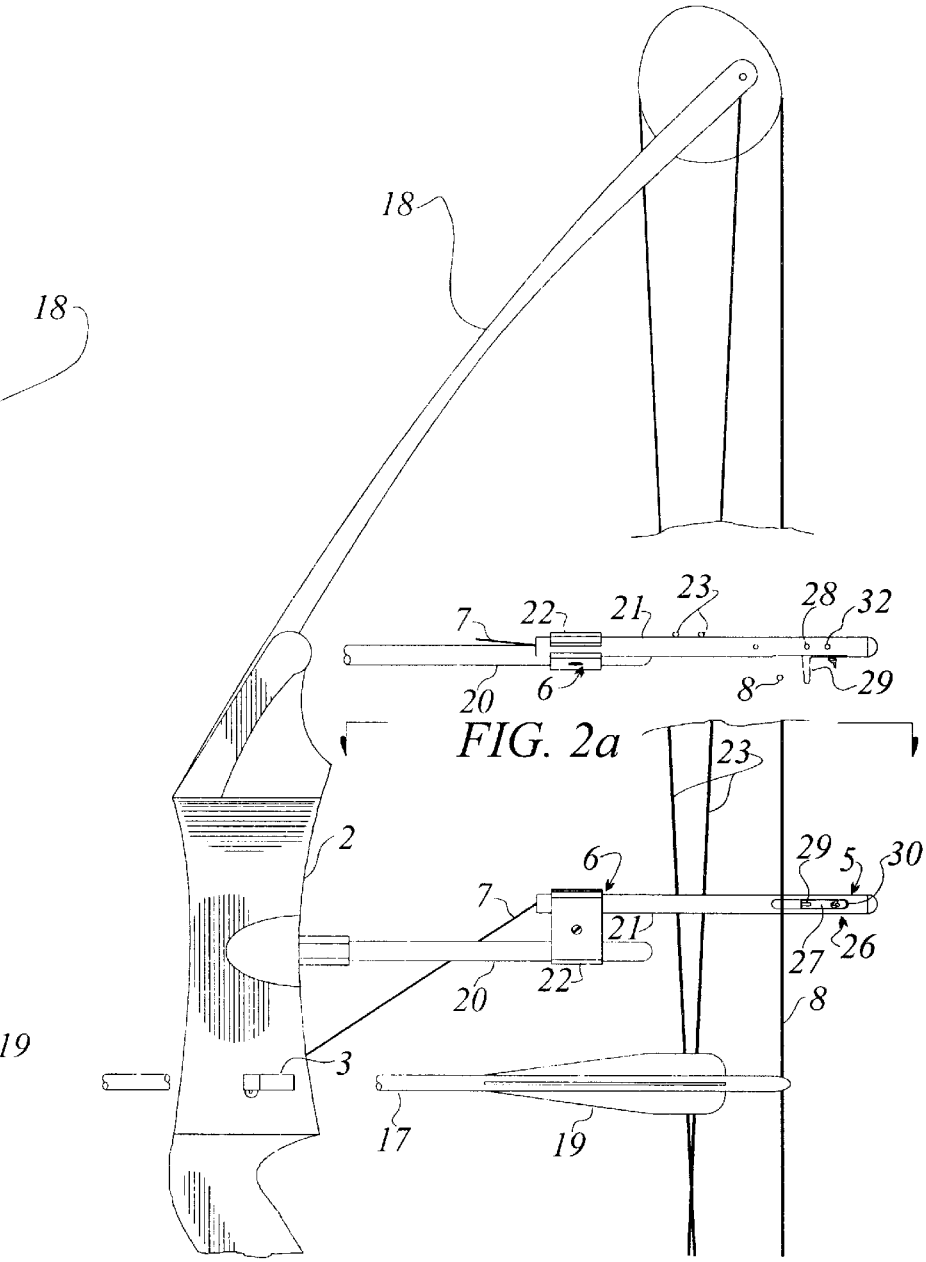
FIG. 2a
FIG. 2
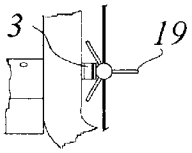
FIG. 1a

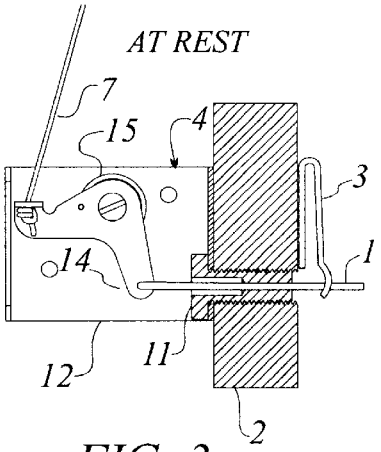
FIG. 3a
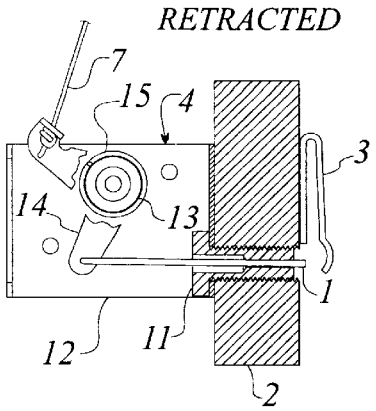
FIG. 3b
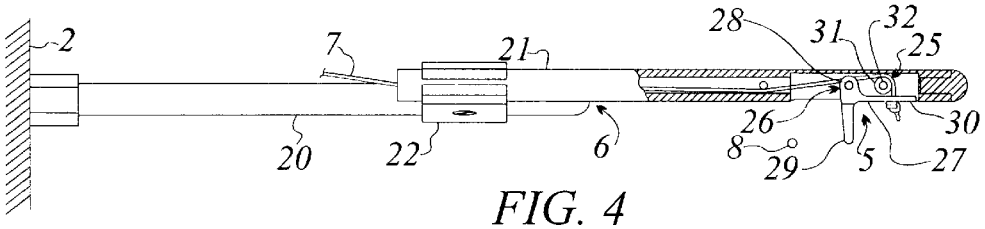
FIG. 4
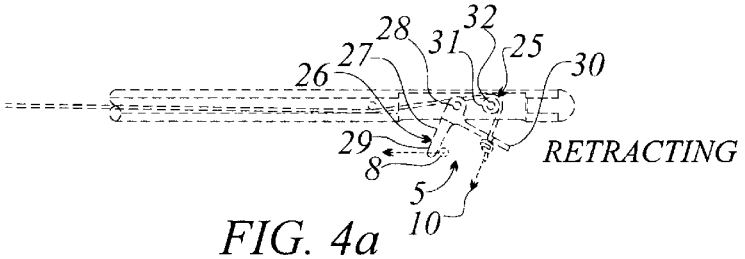
FIG. 4a
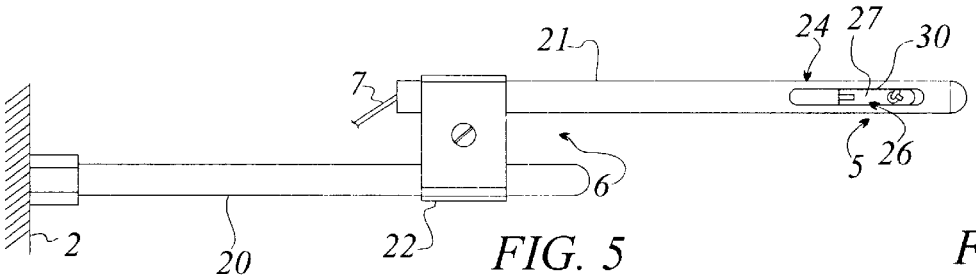
FIG. 5
FIG. 5a

RETRACTING ARROW REST

BACKGROUND OF THE INVENTION

1. Field of the Invention

The present invention relates to archery bows and, more particularly, to a retractable arrow rest device used in such bows, which moves clear of an arrow upon its release from the bow string, thereby preventing deflection of the arrow caused by contact of the feathers, or fletching on the arrow, with the arrow rest or the handle of the bow.

2. Prior Art

U.S. Pat. No. 2,975,780, issued to Fisher on Mar. 21, 1961, discloses a disappearing arrow rest, which is attached to a string connected to one end of a bow. The string exerts a tension on the arrow rest to move it out of an arrow-supporting position unless the bow is drawn. In this arrangement, the arrow rest cannot be positioned to hold an arrow until the bow is drawn, and the timing cannot be controlled.

U.S. Pat. No. 3,504,659, issued to Babington on Apr. 7, 1970, discloses an arrow rest which is held in an upright position by the tension of an elastic band attached to a drawn bow string and which pivots out of the path of the arrow. Rudimentary timing is achieved by varying the length of the elastic band. In this arrangement, the arrow rest cannot be positioned for holding the arrow until the bow is drawn.

U.S. Pat. No. 4,287,868, issued to Schiff on Sep. 8, 1981, discloses an arrow rest which is held in an upright position by a ball detent mechanism; it is pulled down, out of the path of an arrow, by the force of a cable attached to a counter-weighted lever arm attached to one end of the bow; the lever arm is pivoted by inertia from the forward movement of one end of the bow upon release of the arrow. Rudimentary timing is achieved by varying the length of the pivoting lever arm on which the weight is attached. While the arrow rest can be positioned for holding the arrow whether or not the bow is drawn, the lever arm must be cocked; once cocked, it is easily dislodged from the detent mechanism. Also, the timing of the arrow rest release can not be controlled precisely and is very limited in range.

U.S. Pat. No. 5,490,492, issued to Savage on Feb. 13, 1996, discloses an invention similar in function to Babington supra, except the elastic band is attached to the secondary string mechanism of a compound bow rather than the primary bow string. It therefore shares the same limitations.

U.S. Pat. No. 5,503,136, issued to Tone on Apr. 2, 1996, discloses an arrow rest which is pulled out of the path of the fletching by a magnetic force after the column flexure of the arrow has caused it to bow away from the arrow rest. Newly-developed arrows frequently have little or no column flexure after release, as flexure affects accuracy. The rest disclosed not only requires flexure for successful performance, but also relies on the flexure's occurring in a plane parallel to the bow string. Column flexure, however, is both undesirable and, when it occurs, uncontrollable.

Accordingly, it is an object of the present invention to provide an arrow rest which can be positioned to support an arrow firmly without causing tension on the bow.

It is another object of the present invention to provide an arrow rest which moves out of the path of the fletching of a released arrow.

It is still another object of the present invention to provide a horizontally-retracting arrow rest which is responsive to the forward movement of the bow string.

It is a further object of the present invention to provide a retracting arrow rest, the movement of which can be adjusted precisely to control timing.

SUMMARY OF THE INVENTION

These and other objects are accomplished by an arrow rest device which comprises a horizontally-retracting arrow rest and a fixed, flexible positioner, which hold the arrow in proper relation to the bow during drawing and aiming, but which have moved clear of the fletching after release. The flexible positioner is mounted on the bow handle in such a manner as to position the arrow shaft away from the bow handle and in line with the bow string, and clear of the fletching after release. The positioner absorbs any shock generated by the release of the arrow. The arrow rest is a shaft which passes through an opening in the bow handle. The arrow rest depends from a retracting assembly mounted on the bow handle. Also mounted on the bow handle is a trigger-positioning assembly to which is attached a trigger mechanism. The trigger mechanism can be adjusted to different positions relative to the bow string. When an arrow is released, the bow string strikes the trigger, moving it forward, causing a retracting assembly to pull the arrow rest to a position clear of both the arrow and the fletching. Timing can be controlled because the trigger-positioning assembly can be adjusted to change the point in the movement of the bow string at which the trigger is struck.

BRIEF DESCRIPTION OF DRAWINGS

FIG. 1 is a front view of the arrow rest device mounted on a bow handle, shown in partial view;

FIG. 1*a* is a partial front view of the device in FIG. 1, showing the arrow rest in a retracted position;

FIG. 2 is a side elevational view of the arrow rest device of FIG. 1 in relationship to the bow handle and strings;

FIG. 2*a* is a partial top view of the trigger positioning assembly as shown in FIG. 2;

FIG. 3*a* and FIG. 3*b* are detailed cross-sectional top views of the arrow rest, the flexible positioner and the retracting assembly of FIG. 1, before and after retraction;

FIG. 4 is a top view of the trigger positioning assembly and the triggering mechanism, before retraction;

FIG. 4*a* is a partial top view of the triggering mechanism after retraction;

FIG. 5 is a side elevational view of the trigger-positioning assembly and the triggering mechanism; and FIG. 5*a* is a rear elevational view of the trigger-positioning assembly and the triggering mechanism.

DESCRIPTION OF THE PREFERRED EMBODIMENT

Referring now to FIGS. 1 and 2, the present device may be seen to comprise, in general, an arrow rest which passes through a hole in the bow handle 2, a fixed, flexible positioner 3, mounted on the side of bow handle 2 above the arrow rest 1, a retracting assembly 4 mounted on the side of the bow handle 2 opposite the arrow rest 1, from which the arrow rest depends, and a triggering mechanism 5 connected to a trigger positioning assembly 6, mounted on the back of bow handle 2. The bow 18 used may be a long bow, a recurved bow, a compound bow or another kind of bow; it may be left-handed or right-handed. Many modern bows are sold with a threaded hole in the bow handle, which will accommodate mounting of an arrow rest device. The arrow rest 1, made of music wire, is movable between the arrow-holding position shown in FIG. 1, and the retracted, arrow-clearing position shown in FIG. 1*a* (the arrow rest has been retracted). The triggering mechanism 5 is connected to the retracting assembly 4 by an actuating cable 7. Upon contact with the released bow string 8, triggering mechanism 5 moves actuating cable 7, which in turn causes retracting assembly 4 to retract the arrow rest 1.

The fixed, flexible positioner 3, made from brass or spring steel, can be seen in FIG. 2. It comprises a spring device that is positioned above the arrow rest 1 and affixed to the side of bow handle 2. The flexible positioner 3 is bent slightly toward or away from the bow handle 2 in order to position the arrow shaft 17 away from the bow handle 2, perpendicular to the bow limb 18 and in line with the bow string 8. The fletching 19 on the released arrow shaft 17 does not make contact with the flexible positioner 3. The flexibility of the positioner 3 absorbs any shock generated by the release of the arrow 17. Further, any force transferred from the arrow rest 1 to the arrow 17 during retraction will tend to keep the arrow in proper relationship to the bow for greatest accuracy.

In FIGS. 3*a* and 3*b*, the arrow rest 1 and retracting assembly 4 are shown in more detail. The arrow rest 1 is a shaft which passes through the hole of threaded fastener 11, which is embedded in bow handle 2. The threaded fastener 11 also secures the mounting bracket 12 of the retracting assembly 4. On mounting bracket 12, formed from molded plastic or steel, is a plastic spacer 13 and a steel bellcrank 14. The bellcrank 14 is pivotally mounted to the spacer 13 and is free to pivot. The arrow rest 1 is attached to one arm of the bellcrank 14, and one end of actuating cable 7, made from pre-stretched Dacron, is attached to the other arm. The other end of actuating cable 7 is connected to triggering mechanism 5, as shown in FIG. 2. The bellcrank 14 is acted upon by a return spring 15 made of music wire such that, in the arrow rest's 1 at rest position, there is tension on the actuating cable 7, and from its retracted position, the arrow rest 1 returns to the at rest position. When the triggering mechanism 5 moves the actuating cable 7, the bellcrank 14 rotates clockwise, retracting the arrow rest 1. Return spring 15, acting upon bellcrank 14 returns arrow rest 1 to its at rest position. Tension on the actuating cable 7 in the at rest position eliminates slack in the cable which could cause timing to be imprecise.

The trigger-positioning assembly 6, shown in detail FIGS. 2 and 2*a*, comprises a solid steel shaft 20 mounted to the back of bow handle 2, a hollow steel shaft 21 which houses the triggering mechanism 5, and an aluminum or steel clamping device 22, which clamps the two shafts together. By moving the clamping device 22 along the solid shaft 20 or by rotating the clamping device 22 about the solid shaft 20 and rotating the hollow shaft 21 within the clamping device 22, the triggering mechanism 5 can be aligned with and positioned perpendicular to the bow string 8. The triggering mechanism 5 can also be moved horizontally relative to the bow string 8, thereby allowing the archer to control at what point the released bow string 8 will contact the triggering mechanism 5 and retract the arrow rest 1.

FIGS. 2, 4 and 5 show the trigger-positioning assembly 6 mounted on a compound bow. A compound bow has an eccentric pulley arrangement, with secondary bow strings to control both the draw force felt by the archer and the acceleration of the arrow during release. FIG. 2 shows the trigger-positioning assembly 6 attached to the back of bow handle 2, with the hollow shaft 21 between the bow string 8 and the secondary strings 23. FIG. 2*a* shows that secondary bow strings 23 are in contact with the hollow shaft 21. The hollow shaft 21 operates as a "string separator", that is, it holds the secondary strings 23 away from the bow string 8 to allow the free passage of the arrow 17 during release. The trigger-positioning assembly 6 can also be used an long bows or other bows without secondary strings.

As shown in FIG. 4 and FIG. 5, the triggering mechanism 5 comprises a trigger assembly 26 and a roller assembly 25, both mounted at a right angle to the long axis of the hollow shaft 21 of the trigger-positioning assembly 6, and an actuating cable 7. The trigger assembly 26 comprises a steel trigger bellcrank 27, pivotally mounted on a pin 28 inserted in the hollow shaft 21. One arm of the trigger bellcrank 27 is the trigger 29, which protrudes from and is perpendicular to the hollow shaft 21 in its at rest position. The other arm of the trigger bellcrank 27 is the trigger lever 30, which is aligned with the long axis of the hollow shaft 21 in its at rest position. An end of the actuating cable 7 is attached to the trigger lever 30, holding the trigger lever 30 against roller bushing 31 in the at rest position.

The roller assembly 25 comprises a round roller bushing 31 pivotally mounted on a pin 32 inserted in the hollow shaft 21. The plastic roller bushing 31 positions and guides the actuating cable 7, acts as the at rest position stop for the trigger lever 30, and reduces friction on the actuating cable 7 during movement.

The actuating cable 7 is guided around the roller bushing 31 directly above the cable's attachment to the trigger lever 30. This positioning amplifies the actuating cable's 7 travel during release for proper actuation of the retracting assembly 4. The constant tension in the actuating cable 7 in the at rest position eliminates slack in the cable and allows for precise timing.

When the bow string 8 moves toward the bow handle 2 during release of an arrow 17, it contacts the trigger 29, which has been adjusted by the trigger-positioning assembly 6 as to the proper timing of this contact. This contact causes the trigger bellcrank 27 to pivot, causing the trigger lever 30 to pull on the actuating cable 7, which in turn pulls on the retracting assembly 4, which retracts the arrow rest 1 before the fletching 19 of the arrow 17 moves past the arrow rest 1.

A short time after the bow string 8 has contacted the trigger 29, the bow string 8 becomes taut and the arrow 17 leaves the bow string 8. At this time, the arrow 17 has its maximum velocity and aerodynamic stability. Retraction occurs slightly before the arrow 17 leaves the bow string 8, as the fletching 19 of the arrow 17 moves toward the arrow rest 1.

I claim:

1. For a bow for shooting an arrow having fletching, the bow having a handle with two sides and a bowstring which define a bow plane which includes a shooting position for the arrow, a retractable arrow rest for selectively supporting the arrow in the shooting position, comprising:

a flexible positioner mounted on the first side of the handle proximate the shooting position, for spacing the arrow from the handle when in the shooting position;

an arrow support shaft having two ends, slidable through a hole in the bow handle between an extended position in which the first end of the shaft extends beyond the first side of the handle and is effective to support an arrow in the shooting position, and a retracted position in which the first end of the shaft is removed from interference with the arrow as it is released;

the second end of the shaft extending beyond the second side of the handle and connected to a retracting assembly including a retracting crank for controlling the position of the shaft;

a trigger positioning assembly attached to the bow handle and extending rearward beyond the bowstring when the bowstring is in a rest position;

a trigger assembly mounted to the trigger positioning assembly, the trigger assembly including a trigger crank, the trigger crank including a trigger arm extending across the bow plane, and a trigger lever;

an actuating cable extending between the trigger lever of the trigger crank and the retracting crank, such that movement of the trigger crank will be transmitted through the actuating cable to effect movement of the retracting crank;

the arrangement being such that when the bowstring is drawn rearward in preparation for shooting, the arrow support shaft will be in its extended position for supporting the arrow in the shooting position and when the bowstring is released, the bowstring will contact the trigger arm and rotate the trigger crank, causing the retracting crank to rotate and move the shaft to the retracted position, thus avoiding interference with the arrow fletching as the arrow is released.

2. A retractable arrow rest according to claim 1 wherein said retracting assembly comprises a pivotally-mounted retracting bellcrank with two arms, wherein the first arm is attached to the second end of said arrow support shaft, and the second arm is attached to an end of the actuating cable.

3. A retractable arrow rest according to claim 1 wherein said trigger positioning assembly comprises a solid shaft mounted on the bow handle and a hollow shaft, said solid shaft and said hollow shaft movably held in a horizontal, parallel relationship with each other by clamping means.

4. A retractable arrow rest according to claim 3 wherein said trigger positioning assembly is a string separator.

5. A retractable arrow rest device according to claim 1, wherein the trigger assembly additionally comprises a pivotally-mounted roller, a second end of said actuating cable passing over said roller antecedent to attachment to said trigger lever.

* * * * *